United States Patent [19]

Salzer

[11] Patent Number: 4,896,613

[45] Date of Patent: Jan. 30, 1990

[54] COMPOSITE BOMBARDMENT INHIBITING SECTION FOR FRAME MEMBERS

[76] Inventor: Elke Salzer, Weidenhauser Str. 36, 3550 Marburg, Fed. Rep. of Germany

[21] Appl. No.: 218,166

[22] Filed: Jul. 13, 1988

[51] Int. Cl.[4] ..... E05G 3/00; E06B 5/12; E06B 9/00; E04H 9/00

[52] U.S. Cl. ..... 109/27; 109/49.5; 109/79; 52/1; 52/463; 49/DIG. 1

[58] Field of Search ..... 52/461, 463, 1, 468, 52/470; 109/26, 27, 78, 79, 49.5; 49/DIG. 1

[56] References Cited

U.S. PATENT DOCUMENTS

| | | | |
|---|---|---|---|
| 3,574,985 | 4/1971 | Pierce | 52/463 |
| 4,117,640 | 10/1978 | Vanderstar | 49/DIG. 1 |
| 4,428,171 | 1/1984 | Harbin | 49/DIG. 1 |
| 4,461,133 | 7/1984 | Laroche | 49/DIG. 1 |
| 4,625,659 | 12/1986 | Saelzer | 109/49.5 |

*Primary Examiner*—Neill R. Wilson
*Attorney, Agent, or Firm*—Arthur B. Colvin

[57] ABSTRACT

A blast resistant composite section comprises a base section (1), an intermediate section (2), and a solid, bombardment-inhibiting cover section (3). On a side toward the intermediate section (2) the cover section (3) is provided with depressions which form in each instance a groove (9) whose cross-section widens outward in wedge form. Elastically pivotable projections(8) integrally formed with the intermediate section (2) each engage in a groove (9) and are provided in the region of their free edge with an edge (10) of nose-shaped cross section protruding to one side. In the region of the bottom of each groove (9) a lateral enlargement (11) adapted to the cross section of the edge (10) is provided. Due to this design, the cover section (3) can be non-releasably connected to the intermediate section (2) by forces exterted on the cover in a direction perpendicular to the length of the section.

12 Claims, 1 Drawing Sheet

COMPOSITE BOMBARDMENT INHIBITING SECTION FOR FRAME MEMBERS

BACKGROUND OF THE INVENTION

1. Field of the Invention

This invention relates to a composite section for frame members or staves which is composed of a base section, an intermediate section, and a cover section. The cover section, which is solid and bombardment-inhibiting, is provided on its side toward the intermediate section with depressions onto which there engage projections extending from the intermediate section.

2. Prior Art

Such a composite section is known from G No. 86 02 331.4 U1. In the cited reference the base section consists of a box section which is provided on one side with heat insulating stays through which the base section is connected with the intermediate section. To this end, edge strips of heat insulating stays are embedded in grooves of the base section and of the intermediate section, respectively, and are pressed in unreleasably. On the side of the intermediate section away from the base section, an attachment element is screwed on having angularly bent edge strips forming projections which engage in undercut grooves of a cover section made of an aluminum alloy. To apply the cover section, the latter must be slipped on axially in longitudinal direction of the section and must be secured against unintended displacement by additional screws. These safety screws, however, can be screwed in only from the side toward the base section, through the intermediate section, for which reason the width of the intermediate section must be greater than the width of the base section, or else the intermediate section must be laterally offset from the base section in order that the intermediate section protrudes over the base section at least on one side to provide access for insertion of the safety screws.

The design principle of the known composite section has several disadvantages, of which the most important ones are as follows:

In addition to the base section, intermediate section and cover section, it requires for connecting the cover section to the intermediate section at least one attachment element and several fastening and safety screws.

The cover section, made of an especially resistant material, requires a complicated groove cross-section adapted to the angularly bent edge strips of the attachment element, which not only increases the cost of production of the cover section but also reduces the blast resistance thereof over a wide zone.

Lengths of the composite section must have been completed by application of the cover section before frames or staves are formed therefrom, since the cover section cannot be applied subsequently.

The different width dimensions of the base section and of the intermediate section do not permit abutting such composite section at an obtuse angle in corner or crossing regions; instead, they require complicated miter cuts and/or copings of the discrete section parts.

From DE No. 34 04 989 C2 a composite section is known also which consists of a box type base section, an intermediate section formed as an insulating rod, and a solid cover section. In this design, it is true, the application of the cover section does not require additional attachment elements, as the edge of the insulating rod away from the base section is embedded directly in a groove of the cover section and is squeezed therein in the same manner as the opposite edge strip of the insulating rod is embedded and squeezed in a groove of the base section.

A major disadvantage of this design lies in the fact that then the complete composite section must be prefabricated at the factory, since a special rolling tool is required to join the insulating rod, acting as intermediate section, to the base section and to the cover section.

SUMMARY OF THE INVENTION

It is an object of the invention to provide an improved composite section of the initially described kind which can be manufactured from a minimum number of discrete parts and that moreover permits completing the composite section by adding the cover section of the building site after assembly into frames of the base section and of the intermediate section.

To solve this problem there is provided a composite section including a base section, and an intermediate section secured thereto. The intermediate section includes integral resilient projections which may be snap-fittedly connected within complimental grooves formed in a cover section.

Due to the projections integrally formed directly at the intermediate section, supplementary attachment elements to be applied on the intermediate section by screws are obviated in the composite section of the invention. The elastically deformable stays or projections of the intermediate section make it possible to apply the cover section by pressing the latter onto the intermediate section in a direction perpendicular to its length. The stays will then enter into the grooves of the cover section and will be elastically deflected increasingly by the wedge-shaped cross-section of the grooves until the edge of a nose-shaped portion protruding from one side of each stay locks into the lateral enlargement of a complimental groove, whereby the elastic deflection of the stays or projections is reversed until the noses of the stays enter the enlargement of the lateral groove wall with only a slight initial tension, to maintain a connection between the cover section and the intermediate section without play.

It is the function of the wedge-shaped cross-section design of the groove to facilitate introduction of the stays into the grooves, so that the stays need not be pivoted by additional auxiliary means to be able to be introduced into the grooves and clamped. For this purpose it suffices if the wedge-shaped groove cross section is brought about by the obliquity of only that sidewall of the groove which is opposite the edge of nose-shaped cross section. However, the swiveling and clamping of the stays can be accomplished also if the two groove sidewalls are parallel to each other and the deflecting function of an inclined groove sidewall is taken over by the respective slope of the edge of the stay of nose-shaped cross-section. However, in particular for a solid cover section made of blast resistant material the wedge design of the groove cross-section is more advantageous in terms of manufacture than a groove with parallel sidewalls, since the the needed mold core to form the grooves is much easier to handle if the groove cross-section widens outward in wedge form.

According to a development of the invention, the projections of the intermediate section and accordingly the grooves in the cover section are arranged in pairs, and the edges of the projections as well as the enlargements of the grooves of each pair are oriented in mirror symmetry.

By this design not only is the stability of the connection between the cover section and the intermediate section improved, but also it becomes possible to vary the composite section selectively. Thus, according to a further development of the invention, the cover section can be composed of two solid segments, each segment having at least one pair of grooves.

The composite section of the invention, therefore, can be provided either with an undivided cover section of the required width or with a multi-part cover section, and a multi-part cover section in turn can be composed of segments of equal width or segments of different widths. For the covering of the composite this results in numerous possibilities of variation using a small number of stock parts, without the need of giving the remaining section parts a different design or to adapt them in any special way.

The base section and the intermediate section connected therewith may be given a constantly uniform design and be prefabricated at the factory already connected to one another. Thus, this combination of section parts can be kept in stock in commercial lengths, cut to frame members and staves, and assembled. It is only after the panels are installed that the frame members and staves are completed by adding the cover section, which as a rule serves at the same time to additionally fix the panels in position.

The prefabrication of the sub-combination of base section and intermediate section is necessary if, according to a further development of the invention, there are provided in the mutually facing sides of the base section and of the intermediate section grooves for receiving heat insulating stays through which the intermediate section is to be unreleasably connected with the base section.

Another possibility is, of course, to use as base section frame members and staves of any desired design and to screw the intermediate section of the invention onto them. Thus, the cover section and the intermediate section can be used also for the subsequent bombardment-inhibiting design of conventional frame and stave structure, which in this case already contain the base section.

According to a further development of the invention, undercut slide-in grooves for T-shaped or angular connecting pieces are provided on both outer sides of the intermediate section.

Due to the slide-in grooves in the intermediate section, frame members and staves can be strung together, through connecting pieces known per se. The connecting pieces lie in front of the area whose stability is impaired for example by heat insulating connecting stays, so that in the immediate vicinity of the reinforcing cover sections, the frame members and staves have their maximum stability. Forces directed against the cover section are thereby transmitted from the cover section directly to the frame member and stave region, which due to the rigidly interconnected intermediate sections is sturdier than the frame and stave regions remote from the exterior.

Lastly, a particularly advantageous variant of the invention provides making the base section and the intermediate section in a matching width.

This results in the extraordinary advantage that the sub-combination of base section and intermediate section can be cut to the required lengths without miter cuts or copings at right angles and sub-combinations thus cut can be joined together in corner and crossing regions of frame members or staves abutting at an obtuse angle. The cover sections, to be pressed onto a structure thus formed for ultimate completion may, of course, have miter cuts different from the rest of the section parts, as needed, which because of the cross-sectional outer contour of the cover sections—as a rule a rectangular one—involve no appreciable cost.

To provide pivotability of each projection its total cross section is smaller than the cross section of the respective groove. Accordingly, there remains therein a free space between projections and grooves which can be filled by introducing into the groove cavity, just before the pressing on of the cover section, a substance which preferably hardens or may be permanently elastic, as for instance silicone. A hardenable substance further improves the stability of the union between the cover section and the intermediate section and, depending on the hardness of the ultimately solidified substance, imparts to the narrow groove region a resistance comparable to that of the rest of the cover section. On the hand, a permanently elastic substance is suitable in particular if importance is attached in this region to a moisture barrier.

BRIEF DESCRIPTION OF THE DRAWINGS

In the drawing, two embodiment examples of a composite section according to the invention are illustrated as increments of a completed frame or stave in transverse section.

DETAILED DESCRIPTION OF THE DRAWINGS

Figure 1:
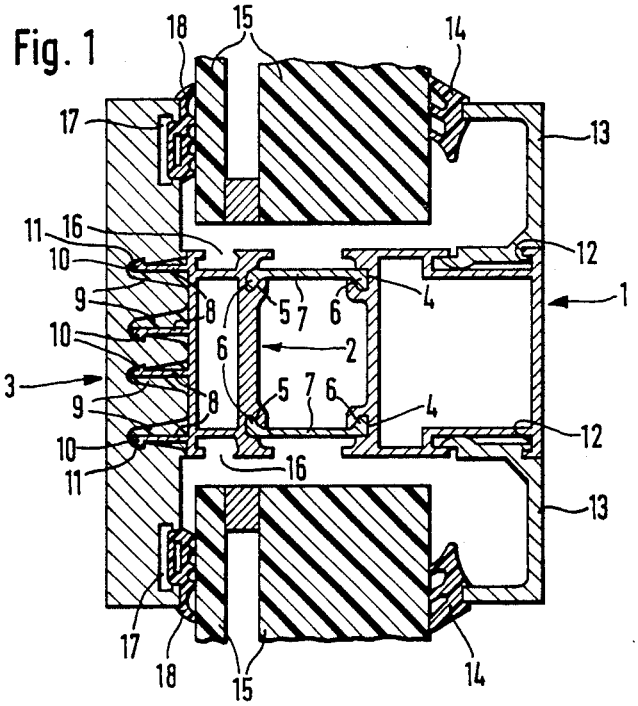
FIG. 1 is a cross section through a frame comprised of a composite section with a one-piece cover section.
Figure 2:
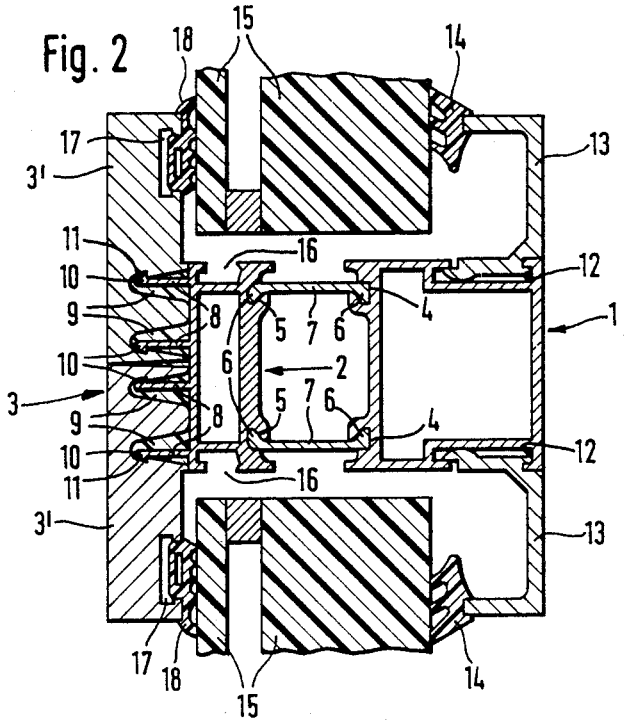
FIG. 2 is a cross section similar to that of FIG. 1 showing a composite section with a two-piece cover section.

In both figures the composite section consists essentially of a box type base section 1 and a likewise box type intermediate section 2. In the embodiment example according to FIG. 1, the composite section terminates on the side susceptible to attack in a one-piece, solid cover section 3 of bombardment-inhibiting design, whereas the difference from the embodiment according to FIG. 2 is that the cover section 3 is composed of two cover section segments 3'.

For connecting the intermediate section 2 to the base section 1, there are provided on their mutually facing sides grooves 4 and 5, in which edge strips 6 of heat insulating stays 7 are embedded and pressed in.

For connecting the cover section 3 to the intermediate section 2, four elastically pivotable stays or projections 8 are integrally formed at the latter on the surface remote from the base section. Each projection 8 engages in a groove 9 of the cover section 3. Each tongue-shaped projection 8 is provided in the region of its free edge with a laterally protruding edge 10 of nose-shaped cross-section, which locks into a lateral enlargement 11 of groove 9 as soon as stay 8 has penetrated deeply enough into groove 9. During the penetration, in fact, because of the cross section of groove 9 widening outward in wedge form to a mouth facing the intermediate section, the stay 8 is at first elastically deflected increasingly, whereby it is prestressed sufficiently to let it snap into the enlargement 11 of groove 9 by its laterally protruding edge 10. The sidewall of groove 9 opposite the respective edge 10 thus brings about by its slope both an easier introduction of stay 8 into groove 9 and in particular also an initial tension of the spring-elastic stay 8, due to which ultimately a permanent union of the cover section 3 with the intermediate section 2 is brought about.

On either side of the base section 1 undercut grooves 12 are provided which serve to receive holding strips 13. By these strips, sealing strips 14 are pressed laterally against panel units 15 shown broken away.

In like manner, on either side of the intermediate section 2 undercut grooves 16 are provided, into which can slide complimentally shaped pieces (not shown) for connecting composite sections arranged at an angle thereto or crossing. Due to the matching width of the base section 1 and of the intermediate section 2, these can be connected in a simple manner and cut at an obtuse angle with section sub-combinations of equal design to form a structure such as a frame.

The cover section 3 lastly, is unreleasably pressed onto the structure thus prepared and equipped with the panels 15, the cover section pressing sealing strips 18 held in grooves 17 of the cover section, laterally against the panel units 15 to thus complete the structure.

I claim:

1. A composite section for forming blast resistant panel frames comprising a base section, an intermediate section having a first side secured to said base section and an opposite side remote from said first side, a plurality of projections extending from said opposite side in a direction away from said base section said projections being integrally formed with said intermediate section, length wisely co-extensive therewith, and being elastically pivotable with respect thereto, said projections including nose portions directed laterally to one side of said projections, a rigid generally planar cover section of thickness in excess of the length of said projections and including grooves recessed into the body thereof and opening toward said intermediate section, said grooves being spaced to receive said projections, said grooves being defined by side walls, a bottom and a mouth facing said intermediate sections, said side walls flaring progressively outwardly in the direction of said mouth to define a cam configuration, said grooves being of substantially greater cross-sectional extent than said projections and including laterally off set enlargements adapted to receive said nose portions of said projections, said projections and grooves being arranged in pairs, said nose portions and grooves of each said pair being oriented in mirror symmetry.

2. A composite section in accordance with claim 1 wherein said cover section is comprised of two segments each said segment having a said pair of grooves.

3. A composite section in accordance with claim 1 wherein said base section and said intermediate section include opposed complimental undercut grooves, the combination including head insulating stays disposed in said complimental grooves non-releasably inter-connecting said base and intermediate section.

4. A composite section in accordance with claim 1 wherein said base section and said intermediate section include opposed complimental undercut grooves, the combination including heat insulating stays disposed in said complimental grooves non-releasably inter-connecting said base and intermediate sections.

5. A composite section in accordance with claim 1 wherein said intermediate section includes side surfaces extending between said first and said opposite sides, said side surfaces including longitudinally extending non-reentrant grooves whereby adjacent said intermediate sections may be inner-connected by connecting pieces spanning the non-re-entrant grooves of adjacent said intermediate sections.

6. A composite section in accordance with claim 5 wherein said base and intermediate sections are of equal widths.

7. A composite section in accordance with claim 1 wherein the space between said projections and grooves is at least partly filled with a self-setting composition.

8. A composite section for forming blast resistant panel frames comprising a base section, an intermediate section including a first side spaced from said base section and an opposite side remote from said first side, said base section and said intermediate section including opposed complemental undercut grooves, heat insulating stays disposed in said complemental grooves and non-releasably interconnecting said base and intermediate sections, a plurality of projections extending from said opposite side in a direction away from said base section, said projections being integrally formed with said intermediate section and being elastically pivotable with respect thereto, said projections including nose portions directed laterally to one side of said projections, a cover section including grooves opening toward said intermediate section, said grooves being spaced to receive said projections, said grooves including side walls, a bottom and a mouth facing said intermediate section, said side walls flaring progressively outwardly in the direction of said mouth to define a cam configuration, said grooves including laterally offset enlargements adapted to receive said nose portions of said projections.

9. A composite section in accordance with claim 8 wherein said projections and grooves are arranged in pairs, said nose portions and grooves of each said pair being oriented in mirror symmetry.

10. A composite section in accordance with claim 8 wherein said intermediate section includes side surfaces extending between said first and said opposite sides said side surfaces including longitudinally extending non-reentrant grooves whereby adjacent said intermediate sections may be inter-connected by connecting pieces spanning the non-reentrant grooves of adjacent said intermediate sections.

11. A composite section in accordance with claim 10 wherein said base and intermediate section are of equal width.

12. A composite section in accordance with claim 8 wherein the space between said projections and grooves is at least partly filled with a self setting composition.

* * * * *